US007992983B2

(12) United States Patent
Nanjo et al.

(10) Patent No.: US 7,992,983 B2
(45) Date of Patent: Aug. 9, 2011

(54) LIQUID CONTAINER

(75) Inventors: Tatsuo Nanjo, Kawasaki (JP); Wataru Takahashi, Kawasaki (JP); Hiroki Hayashi, Yokohama (JP); Yasuo Kotaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 759 days.

(21) Appl. No.: 12/043,774

(22) Filed: Mar. 6, 2008

(65) Prior Publication Data

US 2008/0158314 A1 Jul. 3, 2008

Related U.S. Application Data

(63) Continuation of application No. 11/286,648, filed on Nov. 23, 2005, now Pat. No. 7,387,379.

(30) Foreign Application Priority Data

Nov. 26, 2004 (JP) ..... 2004-342609

(51) Int. Cl.
*B41J 2/175* (2006.01)

(52) U.S. Cl. ..... 347/86

(58) Field of Classification Search ..... 347/85, 347/86, 87

See application file for complete search history.

(56) References Cited

U.S. PATENT DOCUMENTS

| | | | | |
|---|---|---|---|---|
| 5,790,158 | A * | 8/1998 | Shinada et al. | 347/86 |
| 6,070,976 | A * | 6/2000 | Takagi et al. | 347/86 |
| 6,474,797 | B2 * | 11/2002 | Kurata et al. | 347/85 |
| 6,595,711 | B2 * | 7/2003 | Hill | 400/470 |
| 7,387,379 | B2 * | 6/2008 | Nanjo et al. | 347/86 |

FOREIGN PATENT DOCUMENTS

| | | |
|---|---|---|
| JP | 08-090783 A | 4/1996 |
| JP | 09-272210 A | 10/1997 |

* cited by examiner

*Primary Examiner* — Anh T. N. Vo
(74) *Attorney, Agent, or Firm* — Canon USA Inc IP Division

(57) ABSTRACT

A liquid container is provided with an atmospheric air communicating port communicated with atmospheric air in an upper portion thereof, and a liquid supply port for supplying ink contained in the liquid container to a recording head in a lower portion thereof. A negative pressure producing member for retaining ink and imparting a negative pressure to the recording head is contained in the liquid container. On an upper wall in the liquid container on which the atmospheric air communicating port is provided, a plurality of ribs are integrally formed to protrude to the inside of the liquid container. A space portion is formed between the upper wall of the liquid container on which the ribs are disposed and an upper surface of the negative pressure producing member. A capillary channel for generating a capillary force is provided on the upper wall and side walls of the liquid container which form the space portion.

3 Claims, 7 Drawing Sheets

LIQUID CONTAINER

CROSS-REFERENCE TO RELATED APPLICATIONS

This application is a continuation of application Ser. No. 11/286,648 filed Nov. 23, 2005, which claims priority from Japanese Patent Application No. 2004-342609 filed Nov. 26, 2004, all of which are hereby incorporated by reference herein in their entirety.

BACKGROUND OF THE INVENTION

1. Field of the Invention

The present invention relates to a liquid container which is attachably and detachably installed on an ink jet recording apparatus and contains a liquid such as ink for recording.

2. Description of the Related Art

As one form of a recording unit for use in an ink jet recording apparatus, there is one type which has a configuration such that a liquid container is detachably attached to a recording head mounted on a scanning carriage. In this type of liquid container, it is necessary to generate a prescribed negative pressure with respect to the recording head. In this regard, there is another type which utilizes an ink retaining force of a negative pressure producing member which is housed in the ink container and impregnated with ink. This type of liquid container is provided with a liquid supply port through which the contained liquid (ink) is supplied to the recording head, and an atmospheric air communicating port for communicating an interior of the liquid container with atmospheric air and allowing atmospheric air to be introduced into the liquid container.

In the above-described liquid container, if ink seeps from the negative pressure producing member due to a drastic change in the environment at the time of physical distribution, ink may, in some cases, eventually leak from the atmospheric air communicating port to the outside of the liquid container.

As a measure to prevent the ink leakage from the atmospheric air communicating port caused due to a change in the environment and the like, a liquid container which employs a configuration as described in Japanese Patent Application Laid-Open No. 08-090783, for example, has been proposed. In the liquid container disclosed in Japanese Patent Application Laid-Open No. 08-090783, a space (a buffer space) 209 is provided between a negative pressure producing member 204 in the liquid container 201 and an atmospheric air communicating port 203 provided on an upper wall of the liquid container 201 in a state in which the liquid container 201 is used, as shown in FIG. 7. By trapping ink leaking from the negative pressure producing member 204 into the space 209 so as not to allow the leaking ink to reach the atmospheric air communicating port 203, the ink leakage from the inside of the liquid container 202 to the outside can be suppressed.

In addition, a liquid container as disclosed in Japanese Patent Application Laid-Open No. 09-272210 has been proposed as shown in FIG. 8A and FIG. 8B. In this type of liquid container, as shown in FIG. 8A, two atmospheric air communicating paths 211 are configured by forming two grooves on an outer surface of the upper wall in the state in which the liquid container 201 is used and by covering the grooves with a seal tape 212. Further, as shown in FIG. 8B, an ink trap region 210 is provided as an independent space in one part of the liquid container 201. One end of one atmospheric air communicating path 211 is joined to an atmospheric air communicating port 203 which passes through the upper wall of the liquid container 201, and the other end of the one atmospheric air communicating path 211 is joined to the ink trap region 210. One end of the other atmospheric air communicating path 211 is open to atmospheric air by being exposed out of the seal tape 212, and the other end of the other atmospheric air communicating path 211 is joined to the ink trap region 210. With the configuration described above, a space 209 in an upper portion of the liquid container 210 is communicated with atmospheric air via the atmospheric air communicating port 203, one atmospheric air communicating path 211, the ink trap region 210, and the other atmospheric air communicating path 211.

The liquid container 201 shown in FIG. 8A and FIG. 8B is provided with the independent ink trap region 210 in addition to the space 209 provided between the atmospheric air communicating port 203 and the negative pressure producing member 204 employed by the liquid container 201 shown in FIG. 7. Because the liquid container 201 is provided with the ink trap region 210, it is possible to trap ink into the ink trap region 210 even if the ink moves towards the outside of the liquid container 201 through the atmospheric air communicating port 203. Accordingly, it is possible to prevent ink from leaking to the outside of the liquid container 201.

In this regard, the configuration of the above-described liquid container is effective in a case where the level of an impact applied to the liquid container at the time of physical distribution is low. In addition, the configuration of the above-described liquid container is also very effective for preventing ink leakage in a case where the attitude of the liquid container at the time of use thereof is fixed to a prescribed one as in the case of use in a desktop type recording apparatus.

Meanwhile, a mobile type recording apparatus which can be carried to any place by a user, for example, is attracting attention. A liquid container mounted on such a mobile type recording apparatus is carried and used under various kinds of impact, attitude, or environment, as opposed to a desktop type recording apparatus. As for the liquid container used in the recording apparatus which is subjected to the above situation, the countermeasures for the ink leakage as shown in FIG. 7, FIG. 8A, and FIG. 8B are not sufficient because ink may leak from the liquid container.

More specifically, as for the liquid container shown in FIG. 7, FIG. 8A, and FIG. 8B, the mobile type recording apparatus is supposed to be handled in such a manner that the atmospheric air communicating port 203 faces downward in a state in which ink is trapped in the space 209 or the ink trap region 210. If the mobile type recording apparatus is carried in such a manner that various kinds of impacts are applied or various kinds of change in the environment occur in the above situation, the trapped ink may sometimes leak from the liquid container.

One example of a state in which ink leaks from the liquid container is described with reference to FIG. 9A and FIG. 9B. FIG. 9A and FIG. 9B illustrate cross sections of a conventional type liquid container 201 and are views showing the state in which an atmospheric air communicating port 203 faces downward.

For example, as shown in FIG. 9A, suppose a state in which ink is moved due to the impact of falling or the like in such a manner as to penetrate into an ink nonimpregnated region 205 in a negative pressure producing member 204, and closed air bubbles 207 are formed in an ink impregnated region 206. In this case, if the ambient pressure is reduced as in the case of transportation on an airplane or the like, the closed air bubbles 207 are expanded as shown in FIG. 9B. When the closed air bubbles 207 are expanded, ink in the negative pressure producing member 204 is pushed out of the negative pressure producing member 204, and eventually, ink seeps from the negative pressure producing member 204. The seeped ink then accumulates in a buffer space 209 formed with ribs 208 between the negative pressure producing member 204 and a surface having the atmospheric air communicating port 203 formed thereon of the liquid container 201. Since the accumulated ink is directly communicated with the atmospheric air communicating port 203, the ink may easily leak to the outside.

SUMMARY OF THE INVENTION

The present invention is directed to a liquid container capable of preventing ink from leaking to the outside of the liquid container via an atmospheric air communicating port even if an impact is applied to the liquid container or even if a change in the posture thereof or the environment therearound occurs.

In one aspect of the present invention, a liquid container includes a negative pressure producing member impregnated with a liquid, a chamber containing the negative pressure producing member, the chamber having a wall surface, a liquid supply port configured to supply the liquid contained in the chamber, an atmospheric air communicating port provided at the wall surface and configured to communicate an interior of the chamber with atmospheric air, a space portion defined between the wall surface and the negative pressure producing member, and a capillary channel, configured to generate a capillary force, is provided on the wall surface of the chamber which defines the space portion.

In the liquid container according to the present invention, the capillary channel capable of generating a capillary force is provided on the inner wall surface in the space portion. Thus, ink can be trapped into the capillary channel even if ink seeps due to impacts or environmental changes from the negative pressure producing member into the space portion to which the atmospheric air communicating port is opened. In addition, since ink is trapped by the capillary force, ink can be prevented from moving following the posture of the liquid container. Accordingly, ink can surely be retained. Furthermore, because of the configuration that the capillary channel is not communicated with the atmospheric air communicating port, ink can be prevented from leaking to the outside via the atmospheric air communicating port. Accordingly, it is possible to provide a liquid container in which ink does not leak to the outside of the liquid container even if an impact is applied thereto and regardless of a change in the posture and the environment.

Further features of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 8A is a view showing a ceiling surface having an atmospheric air communicating port of the liquid container, and FIG. 8B is a cross section taken along a plane in parallel to a maximum surface area of the liquid container.

DETAILED DESCRIPTION OF THE EMBODIMENTS

Embodiments of the invention will be described in detail below with reference to the drawings.

In each embodiment as described below, an explanation is made by using ink as an example of a liquid used for the present invention. However, a liquid applicable to the present invention is not limited to ink. It is needless to say that, in the field of ink jet recording, for example, a treatment liquid for treating a recording medium may be included.

FIRST EMBODIMENT

Figure 1:
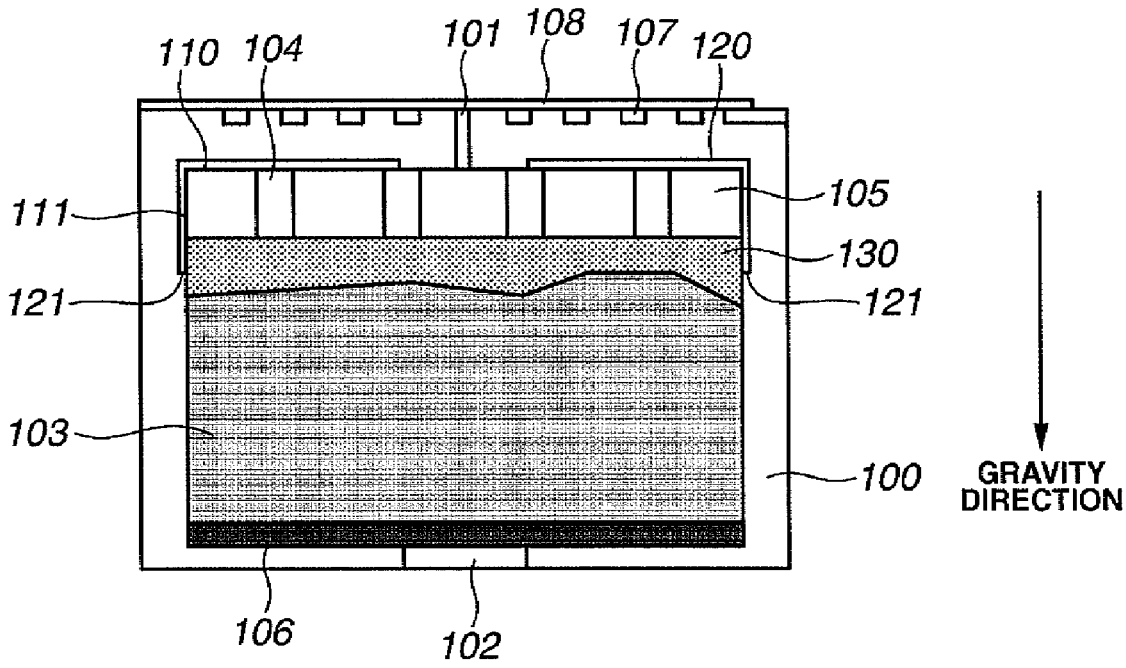
FIG. 1 is a view explaining an outline of a liquid container according to a first embodiment of the present invention, and is a cross section taken along a plane in parallel to a maximum surface area of the liquid container.

FIG. 1 is a view explaining an outline of a liquid container 100 according to a first embodiment of the present invention, and is a cross section taken along a plane in parallel to a maximum surface area of the liquid container 100.

In FIG. 1, the liquid container 100 is provided with an atmospheric air communicating port 101, which communicates with atmospheric air on an upper portion thereof in the direction of gravity indicated by an arrow. In addition, the liquid container 100 is provided with a liquid supply port 102 which supplies ink in the liquid container 100 to an ink jet recording head (not shown) on a lower part thereof. The liquid container 100 contains a negative pressure producing member 103 which retains ink and applies a negative pressure to the recording head, and which is a fiber material of olefinic resin. On an upper wall 110 in the liquid container 100, which has the atmospheric air communicating port 101, a plurality of ribs 104 are formed in such a manner that the ribs 104 protrude to the inside of the liquid container 100. The ribs 104 are in contact with the negative pressure producing member 103 contained in a compressed state in the liquid container 100. The ribs 104 restrain the movement of the negative pressure producing member 103 in the liquid container 100. A space portion 105 is formed between the upper wall 110 of the liquid container 100 on which the ribs 104 are disposed and an upper surface of the negative pressure producing member 103. A capillary channel 120 which generates a capillary force is provided on the upper wall 110 and side walls 111 of the liquid container 100, which form the space portion 105. In addition, a pressure contact member 106 of a sheet-like shape whose capillary force is larger than the capillary force of the negative pressure producing member 103 is provided on the liquid supply port 102. The pressure contact member 106 is in pressure contact with the negative pressure producing member 103.

On an outer side surface of the upper wall 110 of the liquid container 100 on which the atmospheric air communicating port 101 is provided, an atmosphere air communicating groove 107, which is formed in a labyrinth form, is provided. The atmosphere air communicating groove 107 is communicated with the atmospheric air communicating port 101. By sticking a seal tape 108 over the atmosphere air communicating groove 107, an atmospheric air communicating path is formed. In addition, evaporation of ink is suppressed by the existence of the labyrinth-formed atmospheric air communicating path. Thus, occurrence of thickening of ink, which affects a discharge characteristic of the recording head, can be prevented.

The liquid container 100 is tapered (not shown) so that the cross section of the liquid container 100 is gradually decreased towards the liquid supply port 102. This configuration is employed to increase the capillary force of the negative pressure producing member 103 towards the liquid supply port 102.

Figure 2:
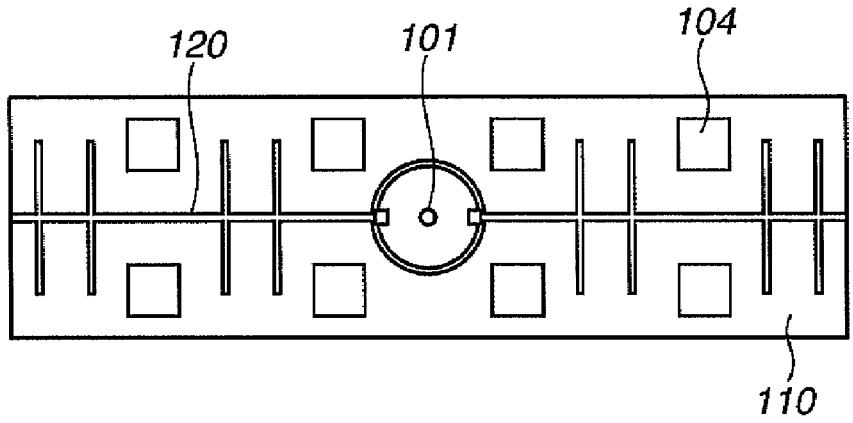
FIG. 2 is a view showing an upper wall of the liquid container according to the first embodiment of the present invention as viewed from an inside of the liquid container.

A configuration of the capillary channel 120 is described next in detail. The capillary channel 120 is provided integrally and in continuation from the upper wall 110 to the side wall 111 of the liquid container 100, which form the space portion 105. An end portion 121 of the capillary channel 120 is located on the side wall 111 and is disposed in contact with the negative pressure producing member 103. FIG. 2 is a view showing the upper wall 110 as viewed from the inside of the liquid container 100. As shown in FIG. 2, the capillary channel 120 is disposed in a matrix in every direction on the upper wall 110 except portions on which the ribs 104 are disposed. The capillary channel 120 is provided continuously and integrally, without interruption. In addition, the capillary channel 120 surrounds the atmospheric air communicating port 101 and is configured not to contact with (not to be communicated with) the atmospheric air communicating port 101.

The capillary force of the capillary channel 120 is described next. A capillary force Mm of the capillary channel 120 is set so that the relation as expressed by an inequality $$Mf>Mm$$

is retained where the capillary force of the negative pressure producing member 103 is Mf.

In this regard, the capillary force Mm of the capillary channel 120 is set to be lower than the capillary force Mf of the negative pressure producing member 103 so that ink is absorbed by the negative pressure producing member 103 when ink guided to the end portion 121 of the capillary channel 120 through the capillary channel 120 comes into contact with the negative pressure producing member 103. In addition, the capillary force Mm of the capillary channel 120 is set so that such a level of capillary force as to draw ink up to the end portion 121 of the capillary channel 120 can be generated in a posture where the atmospheric air communicating port 101 of the liquid container 100 faces downward. Accordingly, ink is guided up to the end portion 121 of the capillary channel 120 regardless of the posture of the liquid container 100. Here, the cross section of the capillary channel 120 in the present embodiment employs a V-shape of an infinitesimal width (not shown). However, the capillary channel 120 in the present invention is not limited to this configuration. That is, various kinds of shapes of cross section may be applied as long as the capillary channel 120 has a shape in which the capillary force satisfying the above relational expression is generated. In addition, in the present embodiment, the capillary channel 120 is formed by forming a groove in the wall surface of the liquid container 100. However, the capillary channel 120 in the present invention is not limited to this configuration. In other words, there is no special limitation on the capillary channel 120 as long as the capillary channel 120 has such a shape that can retain and transfer ink to the negative pressure producing member 103.

Figure 3A:
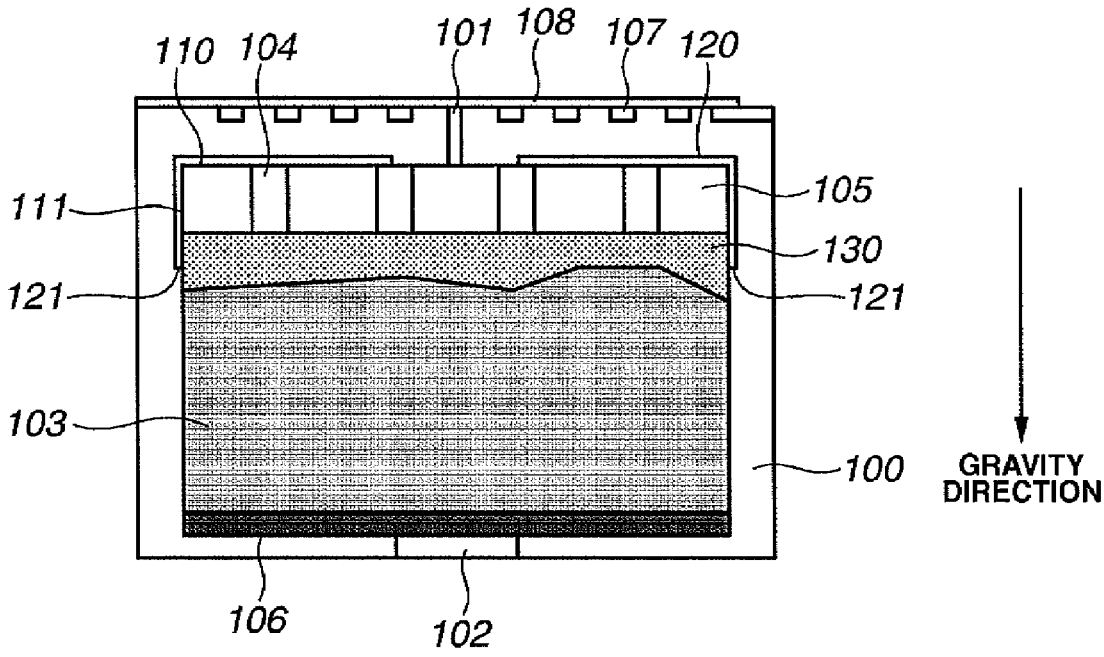
FIG. 3A is a cross section of the liquid container in an initial state thereof according to the first embodiment of the present invention.
Figure 3B:
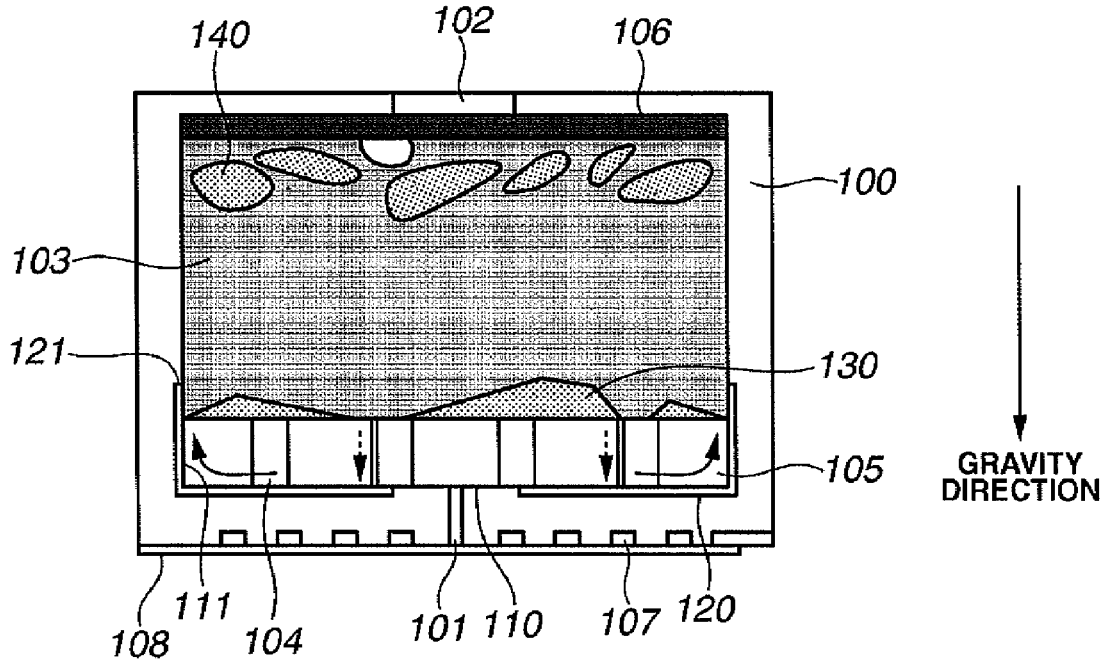
FIG. 3B is a cross section showing a state of the liquid container according to the first embodiment of the present invention after an impact by falling down or the like is applied in a posture where an atmospheric air communicating port faces downward.
Figure 3C:
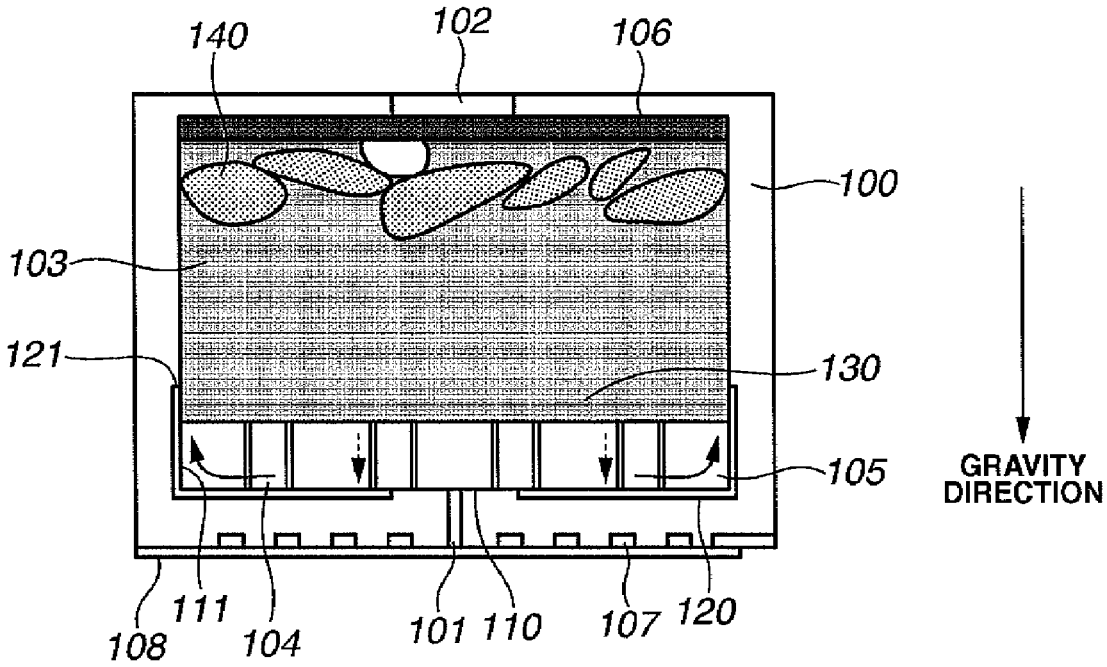
FIG. 3C is a cross section showing a state of the liquid container according to the first embodiment of the present invention when the liquid container is carried into a pressure reducing environment after the state shown in FIG. 3B.
Figure 3D:
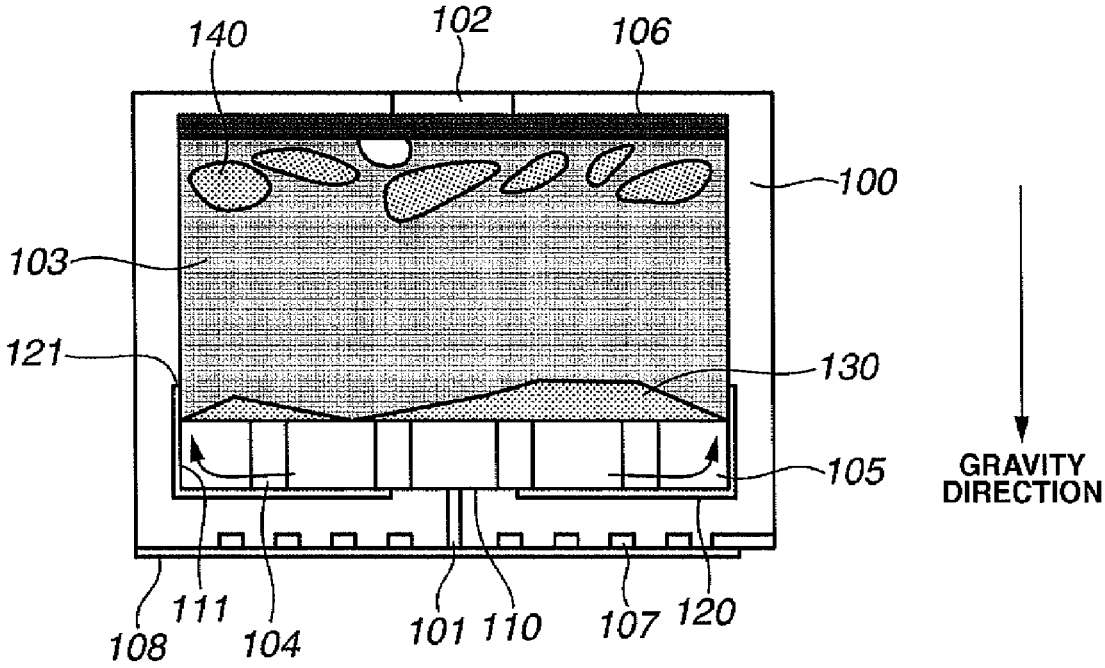
FIG. 3D is a cross section showing a state of the liquid container according to the first embodiment of the present invention where the ambient pressure is returned to an atmospheric pressure after the state shown in FIG. 3C.

Action and effect of the capillary channel 120 are described next with reference to FIGS. 3A through 3D. FIG. 3A is a cross section of the liquid container 100 in an initial state thereof according to the present embodiment. FIG. 3B is a cross section of the liquid container 100 after an impact of falling down or the like is applied in the posture where the atmospheric air communicating port 101 faces downward. FIG. 3C is a cross section of the liquid container 100 when the liquid container 100 is brought into a pressure reducing environment after the state shown in FIG. 3B. FIG. 3D is a cross section of the liquid container 100 in a state in which the liquid container 100 is returned to a state of an atmospheric pressure after the state shown in FIG. 3C.

In a normal state, the liquid container 100 according to the present embodiment is in a form as shown in FIG. 3A. In this state, not the whole region of the negative pressure producing member 103 is impregnated with ink, and, thus, there is a region which is not impregnated with ink, i.e., an ink nonimpregnated region 130. The ink nonimpregnated region 130 is provided so as to serve as an ink buffer in the case of occurrence of an ink movement due to a change in the environment of the liquid container 100. In other words, the ink nonimpregnated region 130 is provided so that in the liquid container 100 which is installed in a desktop type recording apparatus, ink leakage does not occur due to a change in the environment of a level which is likely to occur.

FIG. 3B shows a state of the liquid container 100 in a case where an intense impact is applied to the liquid container 100 shown in FIG. 3A in a posture where the atmospheric air communicating port 101 faces downward in the direction of gravity. The liquid container 100 is extremely reliable in which ink seeping from the negative pressure producing member 103 does not leak to the outside in any applied impact, in any posture, or in any environment. Further, the liquid container 100 installed in a mobile type recording apparatus is highly reliable in which leakage of ink does not occur regardless of any handling by a user. Therefore, an explanation made with reference to FIG. 3B relates to a case where an intense impact generated by the falling down of the whole recording apparatus is applied to the liquid container 100 in a form in which ink is most likely to leak from the atmospheric air communicating port 101 due to the impact, that is, in a state where the atmospheric air communicating port 101 faces downward. In this regard, the action and effect of the liquid container 100 according to the present embodiment in this case are described below.

When an intense impact is applied to the liquid container 100, a strong inertial force is applied to ink. Therefore, as shown in FIG. 3B, ink is moved to the side of the atmospheric air communicating port 101 so that ink penetrates into the ink nonimpregnated region 130. If the applied impact is too intense to allow ink to stay in the negative pressure producing member 103, ink passes over the negative pressure producing member 103 and seeps into the space portion 105 (in the direction of a dotted line arrow). In this case, ink dripping from the negative pressure producing member 103 drops and spreads on the upper wall 110 of the liquid container 100. Here, because the capillary channel 120 is formed in a matrix in every direction all over the upper wall 110, ink dripping from the negative pressure producing member 103 comes into contact with the capillary channel 120. Even if there occurs a case in which ink dripping from the negative pressure producing member 103 does not come into contact with the capillary channel 120, the capillary channel 120 and the ink eventually come into contact with each other by a change in the posture of the recording apparatus occurring when the recording apparatus body is carried. When dripping ink comes into contact with the capillary channel 120, ink is pulled by the capillary force of the capillary channel 120, and, as a result, ink enters the capillary channel 120. The ink which has entered the capillary channel 120 is firmly retained by the capillary force. Therefore, even when the posture of the recording apparatus body is changed to change the posture of the liquid container 100, ink does not flow to reach the atmospheric air communicating port 101. Thus, the ink leakage from the atmospheric air communicating port 101 does not occur.

Further, when ink is increased in an amount larger than a total volume of the capillary channel 120 on the upper wall 110 by the increase of ink trapped by the capillary channel 120, ink moves through the capillary channel 120 and reaches the end portion 121 of the capillary channel 120 (in the direction of a full line arrow). Here, as described above, because the capillary channel 120 has a capillary force of such a level as to draw ink up to the end portion 121 of the capillary channel 120, ink can move without hindrance into the capillary channel 120 on the side wall 111, which stands in the vertical direction in FIG. 3B.

When ink moves up to the end portion 121 of the capillary channel 120, because the capillary channel 120 and the negative pressure producing member 103 are in contact with each other, ink is also brought into contact with the negative pressure producing member 103. In this case, as expressed in the above relational expression, because the capillary force of the capillary channel 120 is set to be lower than the capillary force of the negative pressure producing member 103, ink is absorbed into the negative pressure producing member 103. Accordingly, ink is moved from the capillary channel 120 into the inside of the negative pressure producing member 103, and, thus, ink becomes nonexistent in the capillary channel 120. In this state, the capillary channel 120 can exert again the function of trapping ink, and, thus, can trap ink any number of times because there is no ink accumulated in the capillary channel 120 even if an intense impact is repeatedly applied. In addition, because ink seeping from the negative pressure producing member 103 can be returned to the negative pressure producing member 103, an amount of consumable ink of the liquid container 100 is not decreased.

Figure 4A:
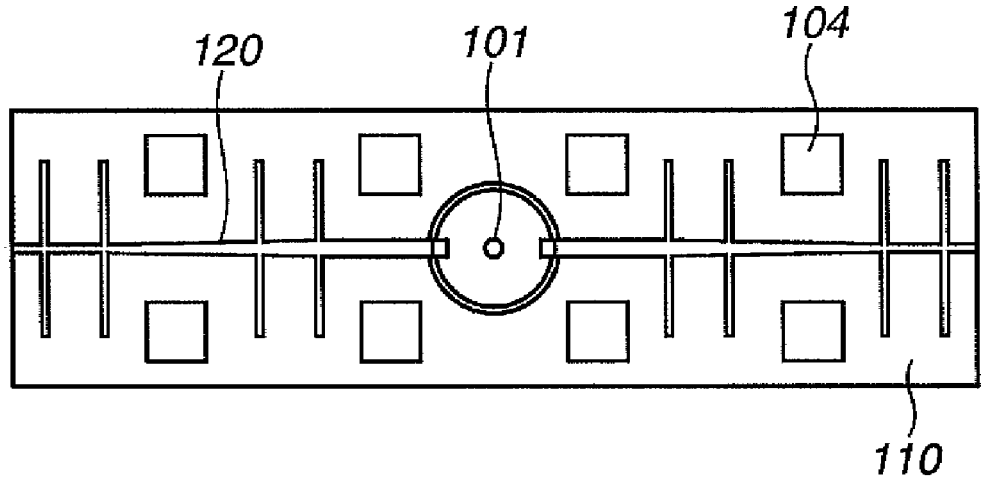
FIG. 4A is a view showing an upper wall of the liquid container according to the first embodiment of the present invention as viewed from the inside of the liquid container, and is a view showing a modification of a capillary channel in the first embodiment.
Figure 4B:
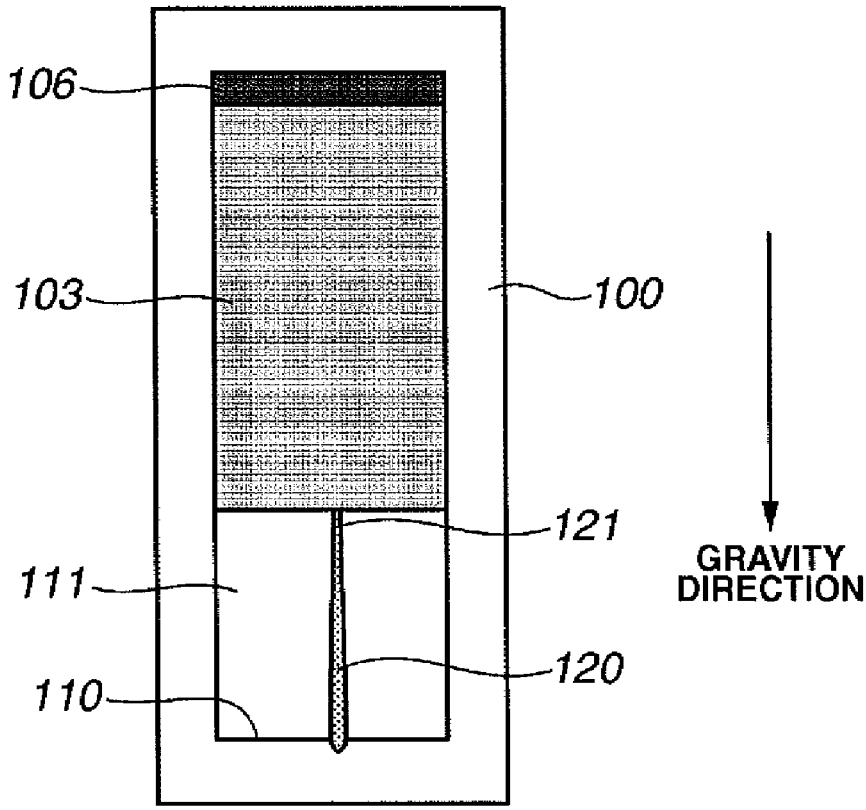
FIG. 4B is a view showing a side wall of the liquid container according to the first embodiment of the present invention as viewed from the inside of the liquid container, and is a view showing a modification of a capillary channel in the first embodiment.

Here, in order to further improve the reliability of the liquid container 100, a form of the capillary channel as shown in each of FIG. 4A and FIG. 4B may be employed. FIG. 4A is a view showing the capillary channel 120 on the upper wall 110 as viewed from the inside of the liquid container 100. FIG. 4B is a view showing the capillary channel 120 on the side wall 111 as viewed from the inside of the liquid container 100.

The capillary channel 120 shown in FIG. 4A takes a form such that the width of the capillary channel 120 on the upper wall 110 is widest in the region in which the atmospheric air communicating port 101 is disposed and the width becomes narrower toward the side wall 111. Because the capillary channel 120 takes this form, ink can be actively kept away from the atmospheric air communicating port 101, and, thus, reliability can be further improved in relation to suppression of the ink leakage from the atmospheric air communicating port 101. Further, the width of the capillary channel 120 on the sidewall 111 shown in FIG. 4B is narrower towards the end portion 121 as compared to the width on the upper wall 110. Accordingly, ink in the capillary channel 120 which reaches the vicinity of the side wall 111 is immediately absorbed into the negative pressure producing member 103.

With respect to the ink leakage from the negative pressure producing member 103, the action and effect of the liquid container 100 according to the present embodiment under the pressure reducing environment after receiving an impact, which can be a harsher situation, are described next with reference to FIG. 3C. FIG. 3C is a view showing a state assumed in a case where the recording apparatus body is carried into a flying airplane after being subjected to an intense impact, i.e., a state of the liquid container 100 in the case of the pressure reducing environment after the state shown in FIG. 3B. This state is the harshest state with respect to the ink leakage from the atmospheric air communicating port 101, because the amount of leakage of ink may be large.

As described above with reference to FIG. 3B, when an intense impact is applied, ink is moved by the inertial force to penetrate into the ink nonimpregnated region 130 in the negative pressure producing member 103. Due to the occurrence of the movement of ink, air enters a region in which ink has existed so far, so that closed air bubbles 140 are formed as shown in FIG. 3B. In this state, when the ambient pressure is reduced, the volume of the closed air bubble 140 in the negative pressure producing member 103 is expanded compared to the volume of the closed air bubble 140 shown in FIG. 3B. By the volume expansion of the closed air bubble 140, ink in the negative pressure producing member 103 is pushed out to the outside of the negative pressure producing member 103, and eventually, a large amount of ink may sometimes leak from the negative pressure producing member 103.

Even when a large amount of ink leaks from the negative pressure producing member 103, ink can be retained by the capillary force of the capillary channel 120 as described above. In addition, because the ink trapping is caused by the capillary force, the ink leakage does not occur regardless of the posture of the liquid container 100, as described above also.

FIG. 3D shows a state of the inside of the liquid container 100 after the liquid container 100 is released from the pressure reducing environment and the ambient pressure is returned to the atmospheric pressure. When the ambient pressure is returned to the atmospheric pressure, the volume of the closed air bubble 140 in the negative pressure producing member 103 is contracted, and a region in which ink can be retained is restored in the negative pressure producing member 103. In this state, if ink reaches the end portion 121 of the capillary channel 120, ink is absorbed into the negative pressure producing member 103. Accordingly, leaking ink is again absorbed into the inside of the negative pressure producing member 103, and the capillary channel 120 can again exert the ink trapping function.

With the configuration of the inside of the liquid container 100, it is possible to continue to trap ink regardless of the posture or environment even if ink leaks from the negative pressure producing member 103. In addition, because it is possible to return the trapped ink to the negative pressure producing member 103 rather than accumulating the trapped ink, it is possible to securely suppress the ink leakage from the atmospheric air communicating port 101. In addition, because the leaking ink returns to the inside of the negative pressure producing member 103, the amount of consumable ink in the liquid container 100 is not decreased.

SECOND EMBODIMENT

A second embodiment of the present invention is described next with reference to FIG. 5. Here, a portion corresponding to the same portion as that of the configuration of the first embodiment is given the same reference numeral as that in the first embodiment, and an explanation is made as to only the points of difference compared with the first embodiment and the action and effect of the second embodiment.

Figure 5:
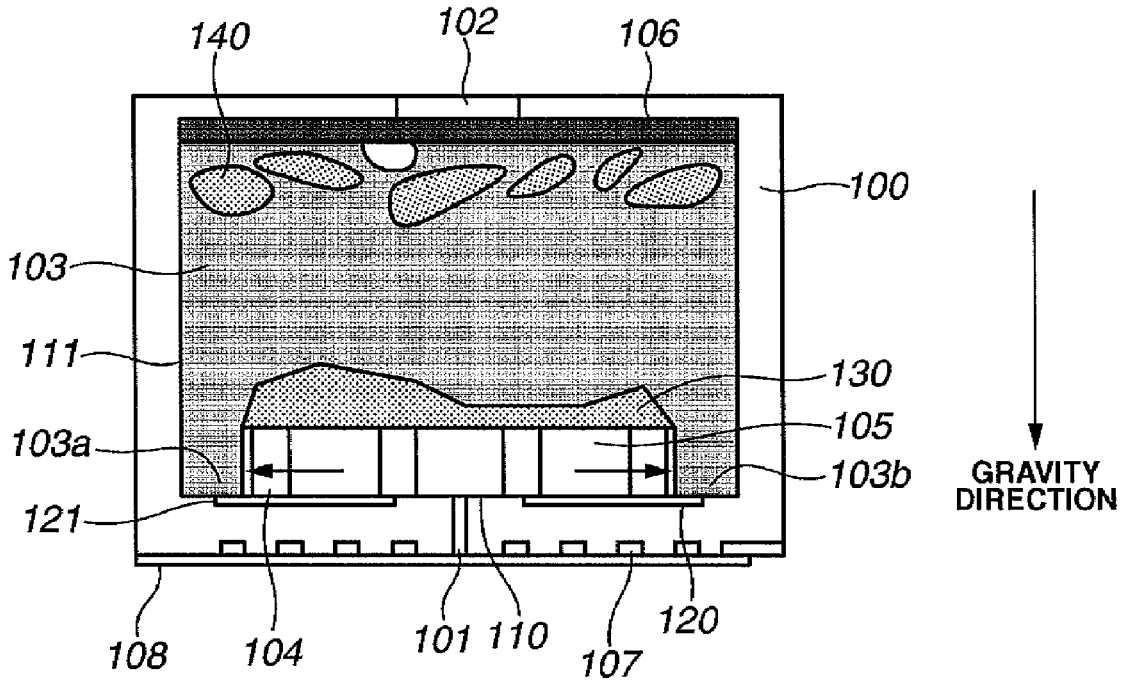
FIG. 5 is a view explaining an outline of a liquid container according to a second embodiment of the present invention, and is a cross section taken along a plane in parallel to a maximum surface area of the liquid container.

FIG. 5 is a cross section taken along a plane in parallel to the maximum surface area of a liquid container 100 according to the second embodiment of the present invention. The liquid container 100 according to the second embodiment takes a form such that two portions 103*a* and 103*b* of the negative pressure producing member 103 extend along the side wall 111 of the liquid container 100 and are in contact with the upper wall 110. At the position at which the negative pressure producing member 103 is in contact with the upper wall 110 of the liquid container 100, a capillary channel 120 is formed. The capillary channel 120 exists only on the upper wall 110 of the liquid container 100, and the end portion 121 of the capillary channel 120 exists at the position at which the negative pressure producing member 103 is in contact with the upper wall 110.

The action and effect of the second embodiment are the same as those of the first embodiment. That is, in the case of occurrence of the ink leakage from the negative pressure producing member 103 due to an applied impact or a reduction of pressure after the impact, leaking ink is retained by the capillary channel 120 provided on the upper wall 110 of the liquid container 100. In addition, because the capillary channel 120 is in contact with the negative pressure producing member 103 at the end portion 121 of the capillary channel 120, the negative pressure producing member 103 can absorb ink in the capillary channel 120 through the contact portion between the negative pressure producing member 103 and the capillary channel 120. With this process repeated, the ink leakage from the atmospheric air communicating port 101 can be surely suppressed.

THIRD EMBODIMENT

A third embodiment of the present invention is described next with reference to FIG. 6. Here, as in the second embodiment, a portion corresponding to the same portion as that of the configuration of the first embodiment is given the same reference numeral as that in the first embodiment, and an explanation is made as to only the points of difference compared with the first embodiment and the action and effect of the third embodiment.

Figure 6:
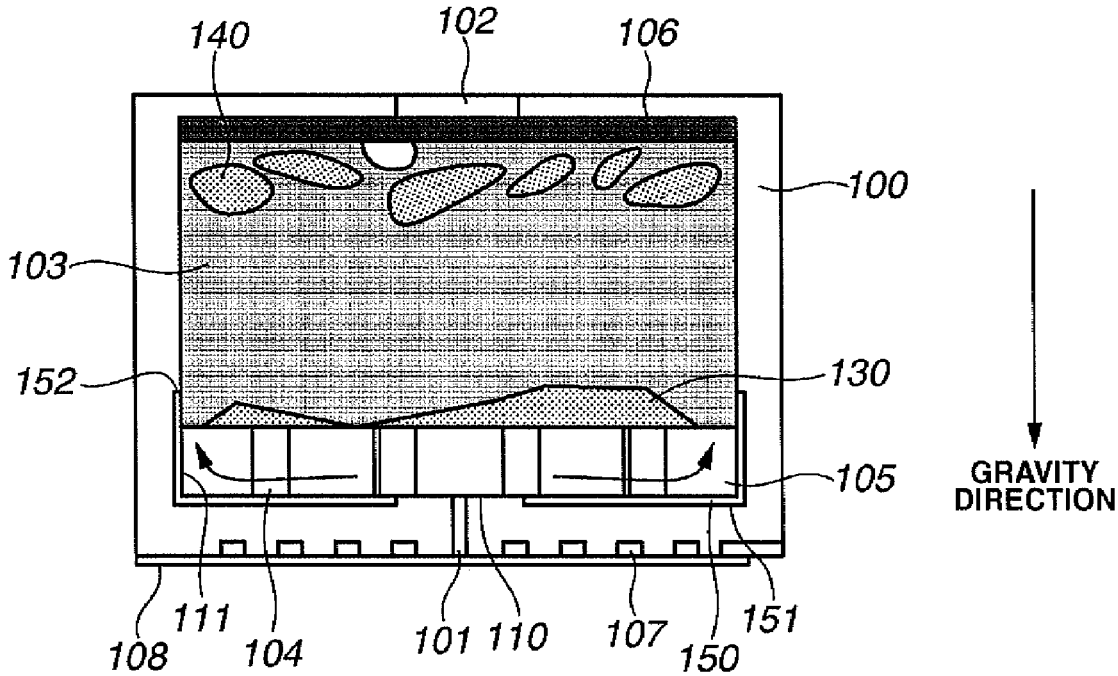
FIG. 6 is a view explaining an outline of a liquid container according to a third embodiment of the present invention, and is a cross section taken along a plane in parallel to a maximum surface area of the liquid container.
Figure 7:
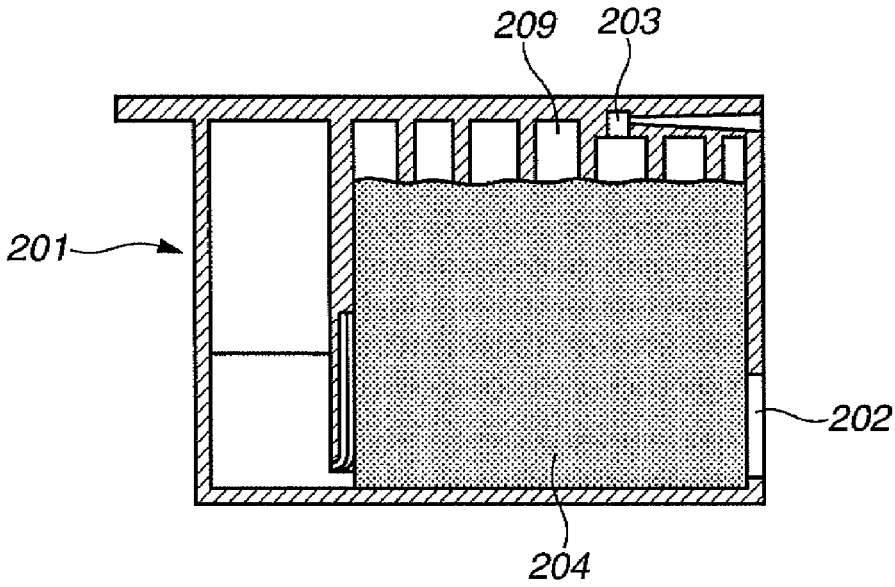
FIG.7 PRIOR ART
FIG. 7 is across section taken along a plane in parallel to a maximum surface area of a liquid container discussed in Japanese Patent Application Laid-Open No. 08-090783.
Figure 8A:
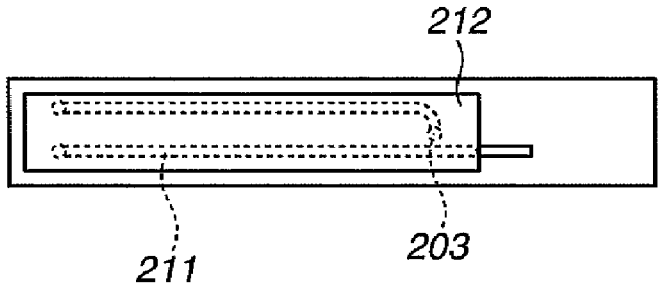
FIG.8A PRIOR ART
FIGS. 8A and 8B are views explaining a liquid container discussed in Japanese Patent Application Laid-Open No. 09-272210.
Figure 8B:
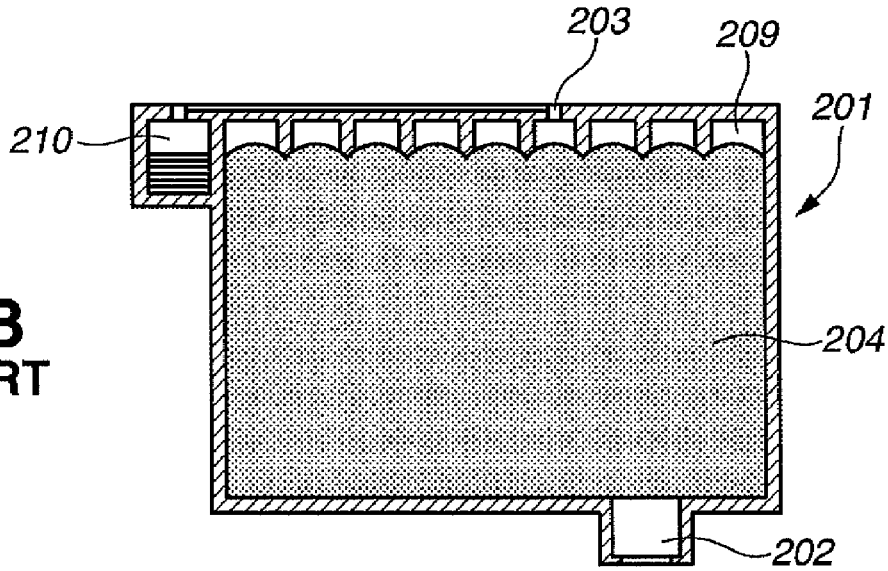
FIG.8B PRIOR ART
Figure 9A:
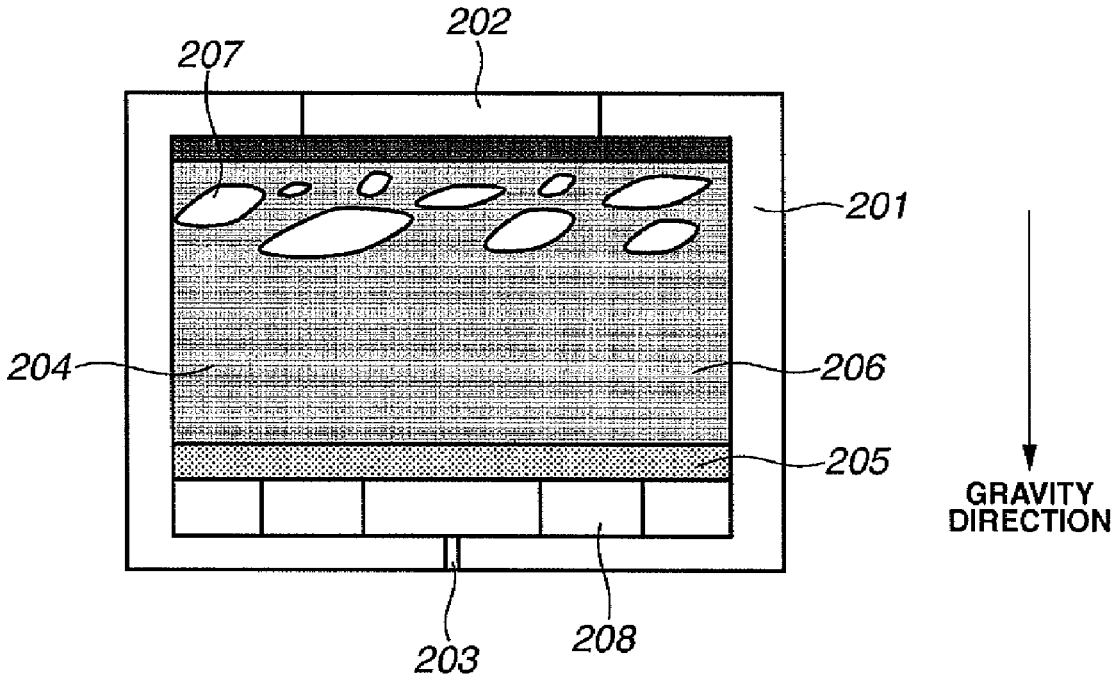
FIG.9A PRIOR ART
FIG. 9A is a view explaining a problem to be solved by the present invention, and is a cross section showing a state of ink in a conventional liquid container in a state where an atmospheric air communicating port faces downward.
Figure 9B:
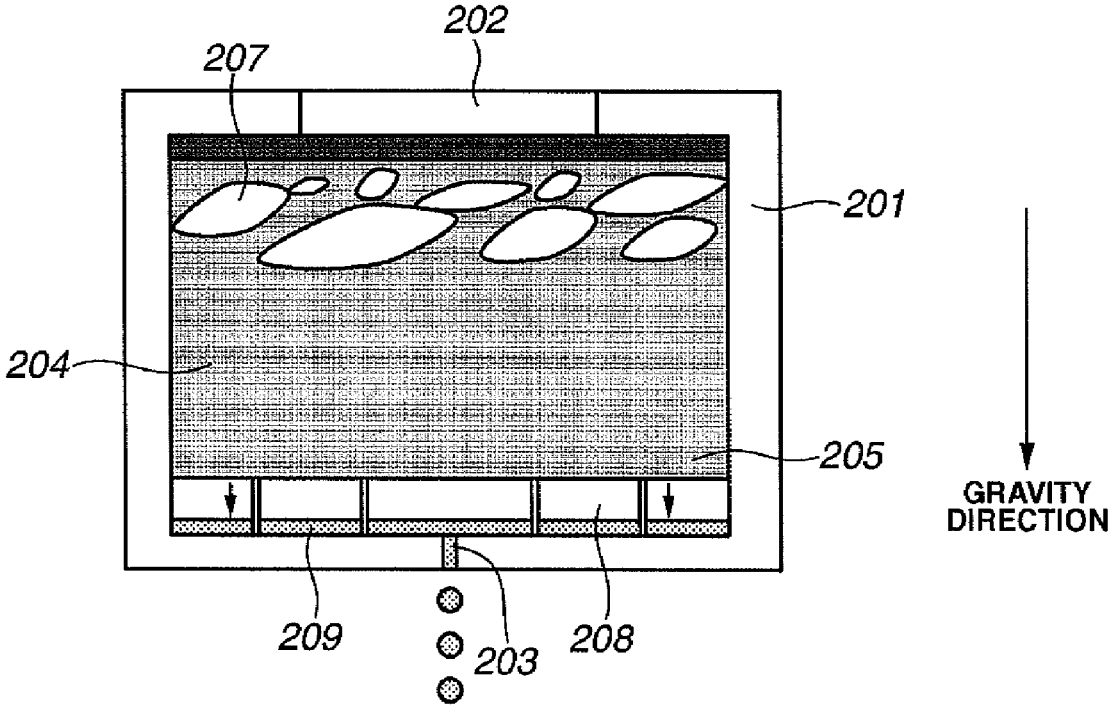
FIG.9B PRIOR ART
FIG. 9B is a view explaining a problem to be solved by the present invention, and is a cross section showing a state where the conventional liquid container is carried into the pressure reducing environment after the state shown in FIG. 9A.

FIG. 6 is across section taken along a plane in parallel to the maximum surface area of a liquid container 100 according to the third embodiment of the present invention. In the liquid container 100 according to the third embodiment, an ink containing member 150 which is capable of absorbing ink is disposed instead of the capillary channel 120 in the first embodiment. The ink containing member 150 is made of a fiber material of olefinic resin, which is equivalent to the material of the negative pressure producing member 103. The capillary force of the ink containing member 150 is set to be lower than the capillary force of the negative pressure producing member 103. The ink containing member 150 is provided integrally and in continuation from the upper wall 110 to the side walls 111 of the liquid container 100, as in the first embodiment. At a position of the liquid container 100 at which the ink containing member 150 is disposed, a groove 151 formed by one step in the upper wall 110 is provided. The ink containing member 150 is contained in the groove 151. An end portion 152 of the ink containing member 150 on the side wall 111 of the liquid container 100 is kept in contact with the negative pressure producing member 103.

The action and effect of the third embodiment are the same as those of the first embodiment. That is, in the case of occurrence of the ink leakage from the negative pressure producing member 103 due to an applied impact or a reduction of pressure after the impact, leaking ink is retained by the ink containing member 150 provided on the upper wall 110 of the liquid container 100. In addition, because the ink containing member 150 is in contact with the negative pressure producing member 103 at the end portion 152 of the ink containing member 150, the negative pressure producing member 103 can absorb the ink retained in the ink containing member 150 through the contact portion between the negative pressure producing member 103 and the ink containing member 150. With this process repeated, the ink leakage from the atmospheric air communicating port 101 can be surely suppressed.

In the liquid container 100 according to the above-described embodiments, the capillary channel 120 or the ink containing member 150 is provided on the inner surface of the upper wall 110 and the inner surfaces of the side walls 111. Accordingly, even if ink leaks from the negative pressure producing member 103 due to various causes, the leaking ink can be trapped. Furthermore, because ink is trapped by the capillary force, ink does not move by following the posture of the liquid container 100. Thus, ink can be retained in the liquid container 100.

Further, the capillary channel 120 or the ink containing member 150 is configured to be in contact with the negative pressure producing member 103 at the end portion 121 of the capillary channel 120 or at the end portion 152 of the ink containing member 150. Accordingly, the ink trapped by the capillary channel 120 or the ink containing member 150 is guided up to the negative pressure producing member 103. In this case, because the capillary force of the capillary channel 120 and the ink containing member 150 is set to be lower than the capillary force of the negative pressure producing member 103, the ink which passes through the capillary channel 120 or the ink containing member 150 comes into contact with the negative pressure producing member 103 and is then absorbed into the negative pressure producing member 103.

Therefore, the capillary channel 120 or the ink containing member 150 is not filled with ink and is capable of functioning at any time. Accordingly, the accumulated ink does not overflow to the outside of the liquid container 100. Thus, a high-reliability liquid container can be provided. Furthermore, because ink is returned to the inside of the negative pressure producing member 103, the amount of consumable ink in the liquid container 100 is not decreased.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. A liquid container comprising:

a negative pressure producing member impregnated with a liquid;

a chamber containing the negative pressure producing member, the chamber having a wall surface;

a liquid supply port configured to supply the liquid contained in the chamber;

an atmospheric air communicating port provided at the wall surface and configured to communicate an interior of the chamber with atmospheric air;

a space portion defined between the wall surface and the negative pressure producing member; and a channel provided on the wall surface of the chamber which defines the space portion, wherein the channel is provided surrounding the atmospheric air communicating port and is not communicated with the atmospheric air communicating port.

2. A liquid container according to claim 1, wherein the liquid container is configured to be exchangeable with respect to a recording head.

3. A liquid container according to claim 1, wherein the liquid container is configured integrally with a recording head.

* * * * *